US006887141B1

(12) United States Patent
Lin

(10) Patent No.: US 6,887,141 B1
(45) Date of Patent: May 3, 2005

(54) GRINDER WITH FAST INSTALLABLE/DETACHABLE GRINDING DISC

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 10/772,245

(22) Filed: Feb. 6, 2004

(51) Int. Cl.[7] ..... B24B 23/00

(52) U.S. Cl. ..... 451/357; 451/359; 451/358; 451/356

(58) Field of Search ..... 451/357, 358, 451/359, 295; 229/2.19, 66, 110, 904, 131, 229/75, 22, 30; 409/233; 30/392, 393, 394; 83/666, 698, 698.4

(56) References Cited

U.S. PATENT DOCUMENTS 4,657,428 A * 4/1987 Wiley ..... 403/359.3
4,787,147 A * 11/1988 Wiley ..... 30/388
5,157,873 A * 10/1992 Rudolf et al. ..... 451/342
5,518,441 A * 5/1996 Valentini ..... 451/357
6,409,584 B1 * 6/2002 Lin ..... 451/295
6,547,654 B1 * 4/2003 Del Raso ..... 451/441
6,685,546 B1 * 2/2004 Del Raso ..... 451/356
6,752,704 B1 * 6/2004 Lin ..... 451/295

* cited by examiner

*Primary Examiner*—George Nguyen
(74) *Attorney, Agent, or Firm*—Troxell Law Office PLLC

(57) ABSTRACT

A grinder with fast installable/detachable grinding disc, including: a main body; a rotary shaft disposed at bottom end of the main body, a shaft rod of the grinding disc being mounted in the shaft hole of the rotary shaft, whereby the grinding disc is drivable by the rotary shaft; a rotary switch mounted on the main body; a linking device mounted at bottom end of the main body and drivable by the rotary switch; and a detent mechanism mounted in the rotary shaft. When the rotary switch is rotated to drive and move the linking device to a first position, the detent mechanism is moved into the shaft hole of the rotary shaft to fix the shaft rod of the grinding disc in the shaft hole. When the rotary switch is rotated to drive and move the linking device to a second position, the detent mechanism is moved out of the shaft hole of the rotary shaft to release the shaft rod of the grinding disc. Accordingly, the grinding disc is fast replaceable by means of simple operation.

20 Claims, 9 Drawing Sheets

GRINDER WITH FAST INSTALLABLE/DETACHABLE GRINDING DISC

BACKGROUND OF THE INVENTION

The present invention is related to a grinding device, and more particularly to a grinder in which the grinding disc is fast replaceable by means of simple operation.

A conventional pneumatic or electric grinder has a grinding disc mounted at bottom end for grinding or buffering a work piece. When grinding different work pieces, it is necessary to frequently replace the grinding disc.

In the conventional grinding structure, an eccentric rotary shaft is disposed at bottom end of the rotor (pneumatic grinder) or the motor (electric grinder). A hexagonal nut is fixed at bottom end of the rotary shaft. A worm is disposed at the center of the top face of the grinding disc. The worm is screwed in the nut, whereby the grinding disc is drivable by the rotary shaft. In addition, a protective sheath is disposed at bottom end of the grinder for covering the grinding disc and providing a protective effect.

The conventional grinder is equipped with a flat wrench. When replacing the grinding disc, the wrench is extended through the gap between the protective sheath and the grinding disc to fit onto the nut and prevent the rotary shaft from rotating. Under such circumstance, the grinding disc can be untightened or tightened. Such procedure is quite inconvenient, for the protective sheath obstructs the operator from seeing the nut. Therefore, it is hard for the operator to fit the wrench onto the nut. Moreover, the rotary shaft is eccentrically arranged and has unfixed position so that the operator often needs to try many times for wrenching the nut.

Furthermore, in case there is no tool available, it will be impossible to replace the grinding disc.

Moreover, in the conventional structure, when screwing the grinding disc on the rotary shaft, it is necessary to rotate the grinding disc by several circles. This will waste some time.

SUMMARY OF THE INVENTION

It is therefore a primary object of the present invention to provide a grinder in which the grinding disc can be fast installed/detached.

It is therefore a primary object of the present invention to provide the above grinder in which the grinding disc can be replaced without using any tool.

The present invention can be best understood through the following description and accompanying drawings wherein:

DETAILED DESCRIPTION OF THE PREFERRED EMBODIMENTS

Figure 1:
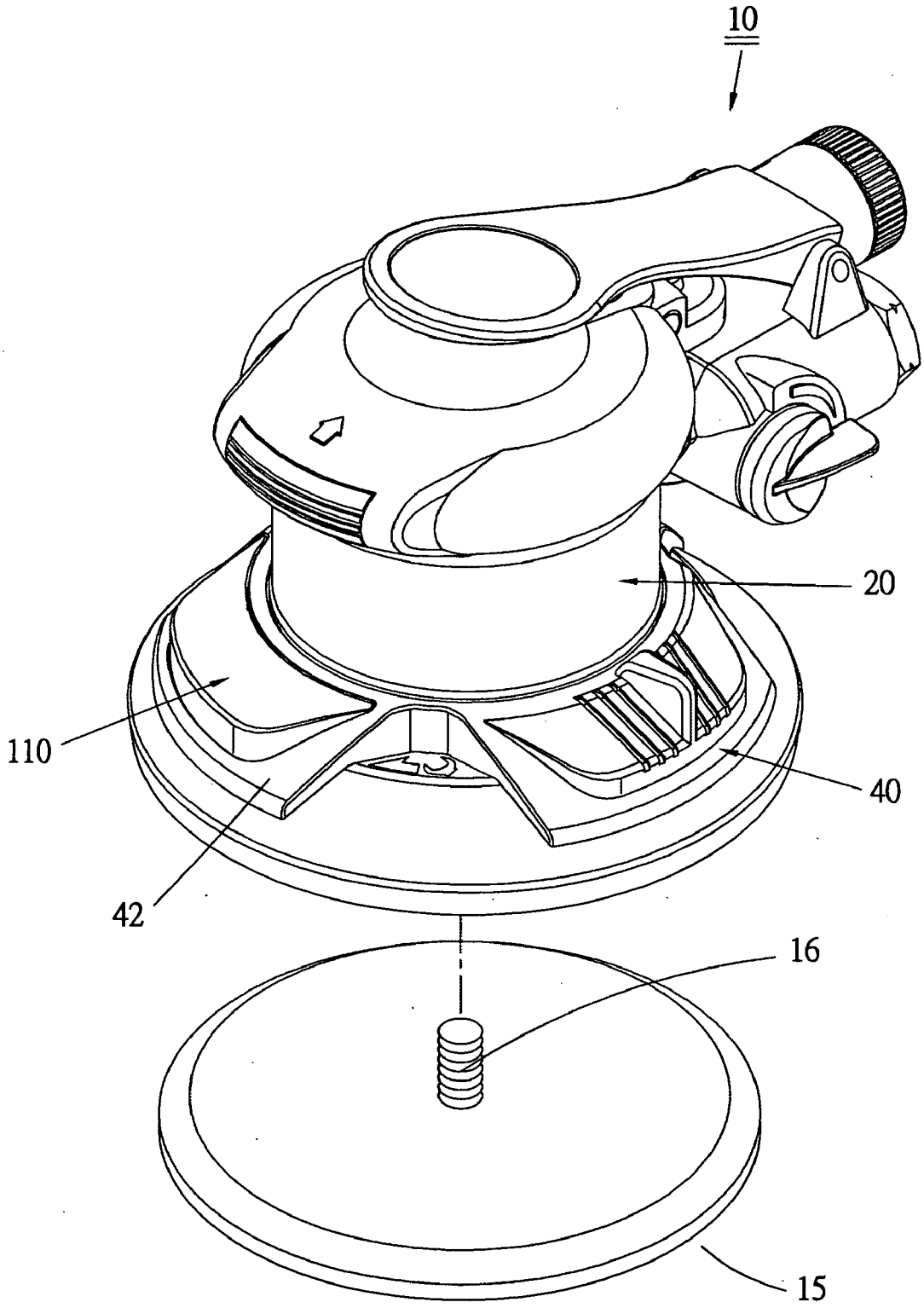
FIG. 1 is a perspective view of a preferred embodiment of the present invention.
Figure 2:
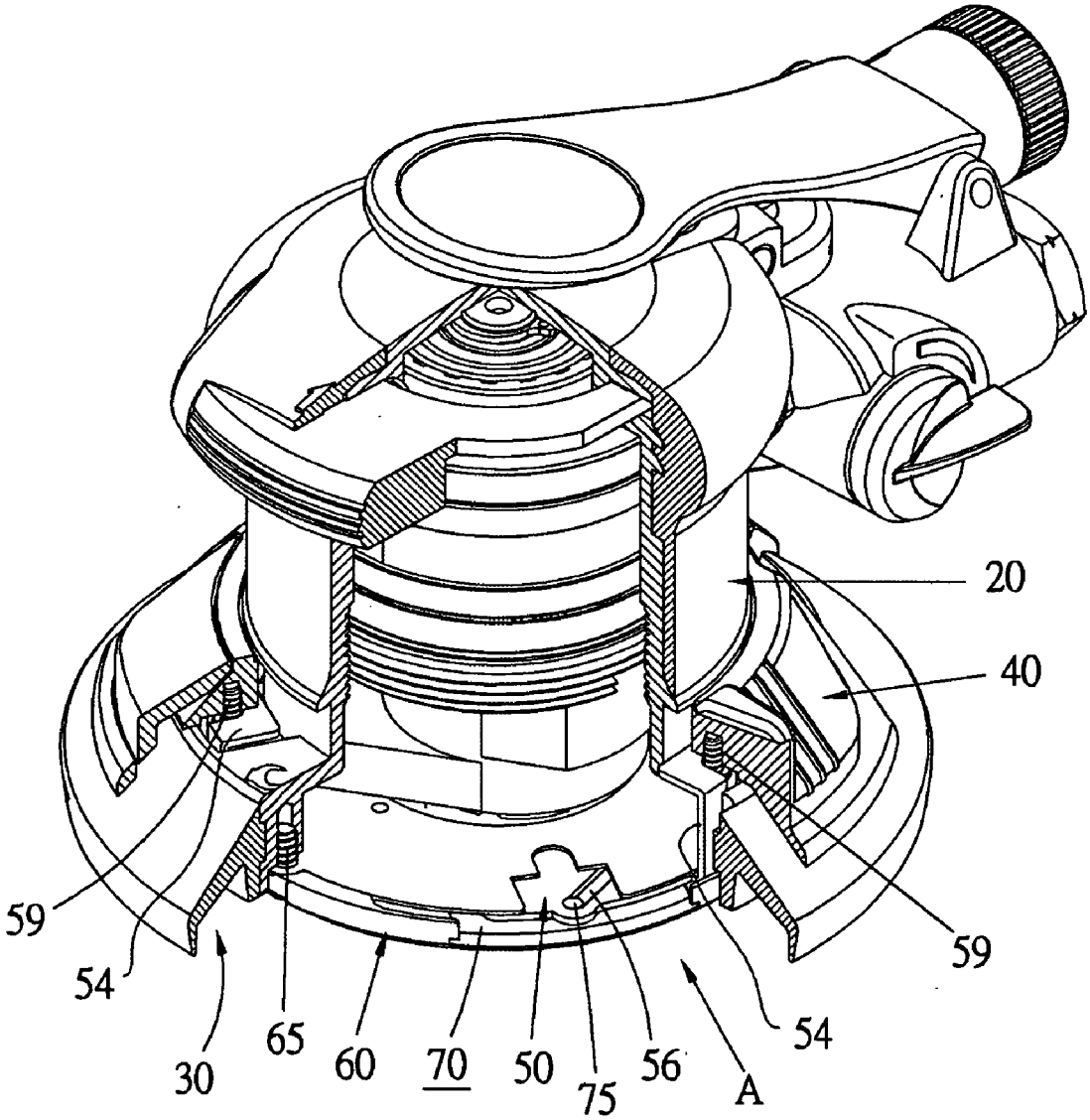
FIG. 2 is a perspective partially sectional view of the preferred embodiment of the present invention according to FIG. 1.
Figure 3:
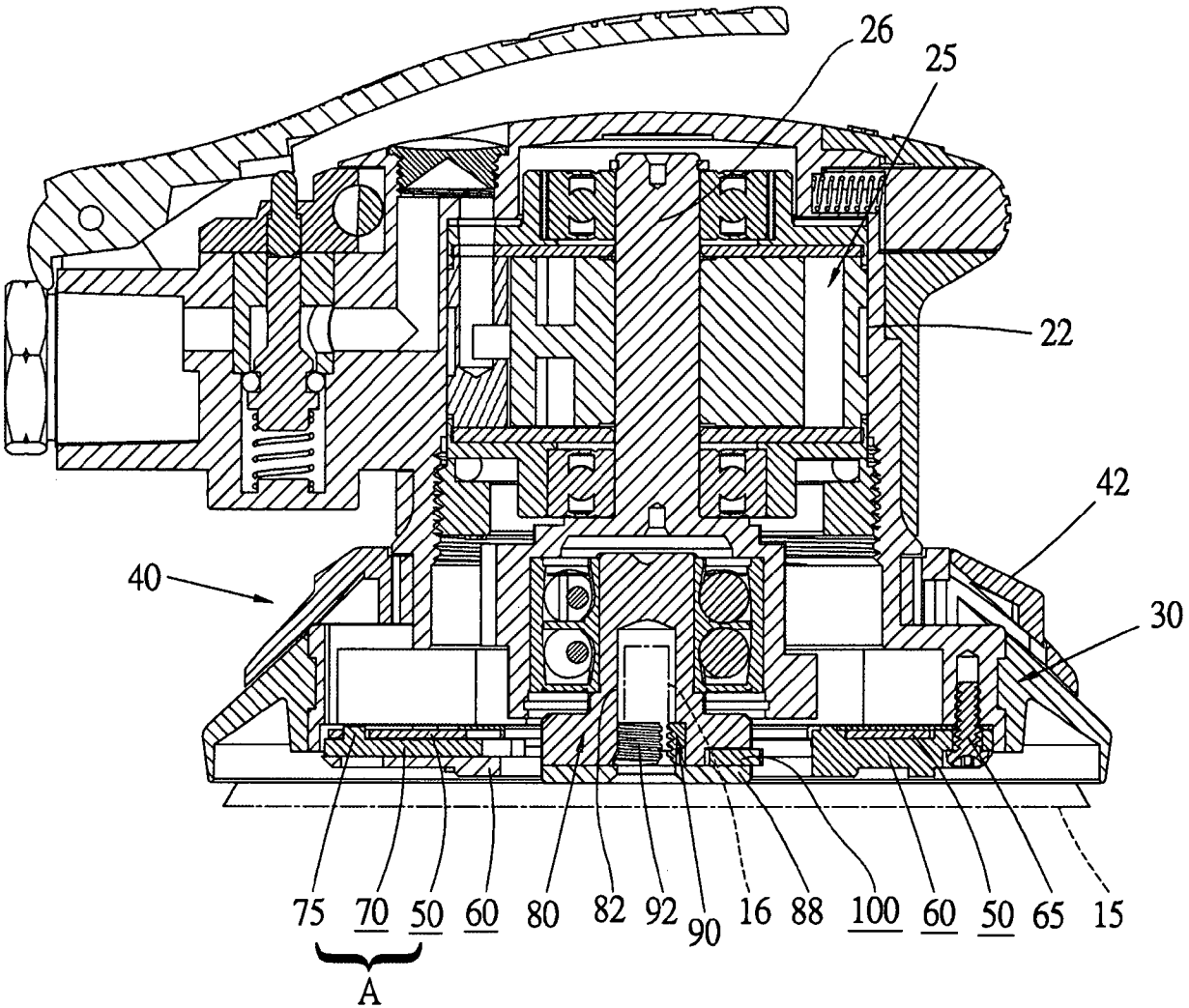
FIG. 3 is a longitudinal sectional view according to FIG. 1.

Please refer to FIGS. 1 to 3. According to a preferred embodiment, the grinder 10 of the present invention includes a main body 20 having an internal space 22 in which a driving device 25 is installed. In this embodiment, the grinder is a pneumatic grinder so that the driving device is a pneumatic cylinder for driving a driving shaft 26. A hollow annular body 30 is fitted with bottom end of the main body 20. The annular body 30 has an inner diameter larger than the diameter of the main body 20. The inner circumference of the annular body 30 has three connecting sections 32 arranged at equal intervals for connecting with the main body. The three connecting sections define therebetween three hollow sections 34 at equal intervals. In this embodiment, the annular body 30 is composed of an annular section and a soft protective cover fitted on the annular section. This pertains to prior art and will not be further described hereinafter.

The present invention further includes a rotary switch 40. Referring to FIGS. 1 and 2, in this embodiment, the rotary switch 40 is composed of three arched bodies 42 to form a circular configuration. The arched bodies 42 are annularly arranged around the annular body 30. The arched bodies 42 can be angularly displaced on the annular body 30. Two leaf springs 44 are disposed on inner circumference of each arched body 42. The inner circumference of each leaf spring is recessed to form an engaging section 441. Several locating sections 201 are disposed on the circumference of the main body 20. The engaging section 441 can engage with one of the locating sections 201 to locate the rotary switch 40.

The present invention further includes a linking device A including a bracket 50, a support tray 60 and three push plates 70. The linking device A is mounted at bottom end of the main body and drivable by the rotary switch.

The bracket 50 has a hollow disc-shaped body section 52 and three leg supports 54 arranged on the body section at equal intervals. The leg supports 54 upward extend from the body section. Three oblique guide slots 56 are formed on the body section 52 at equal intervals. The three leg supports 54 respectively extend through the three hollow sections 34 and are fixedly connected with the rotary switch 40 by three screws 59 as shown in FIG. 2. Accordingly, when rotating the rotary switch 40, the bracket 50 is driven and angularly displaced.

The support tray 60 is also a hollow tray body. Three rail channels 62 are formed on top face of the support tray 60 at equal intervals. The longitudinal length of the rail channel 62 is parallel to the radius of the support tray 60.

Figure 11:
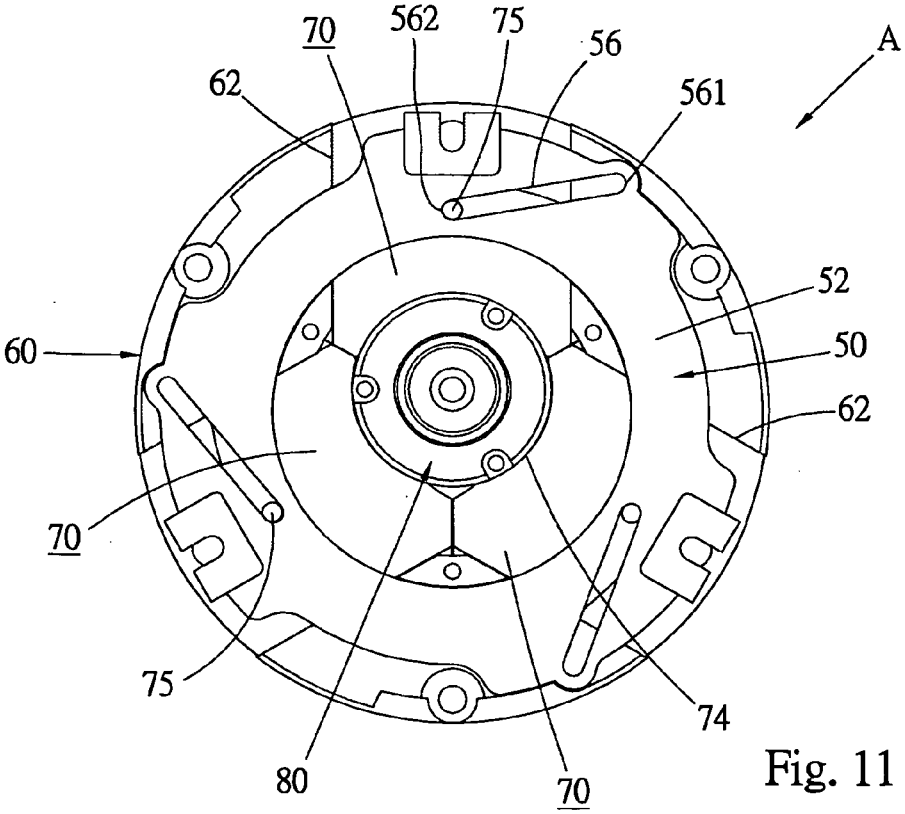
FIG. 11 is a view according to FIG. 5, showing that the push plates are positioned in the closed position.

The three push plates 70 are respectively disposed in the three rail channels 62 and slidable along the rail channels. An inner end of each push plate 70 is an arched end 74. When the push plates are closed, the three arched ends 74 form a circular configuration as shown in FIG. 11. Said circular configuration is eccentrically arranged, not positioning at the center of the push plates. Three guide posts 75 are respectively fixedly disposed on the three push plates 70.

Figure 5:
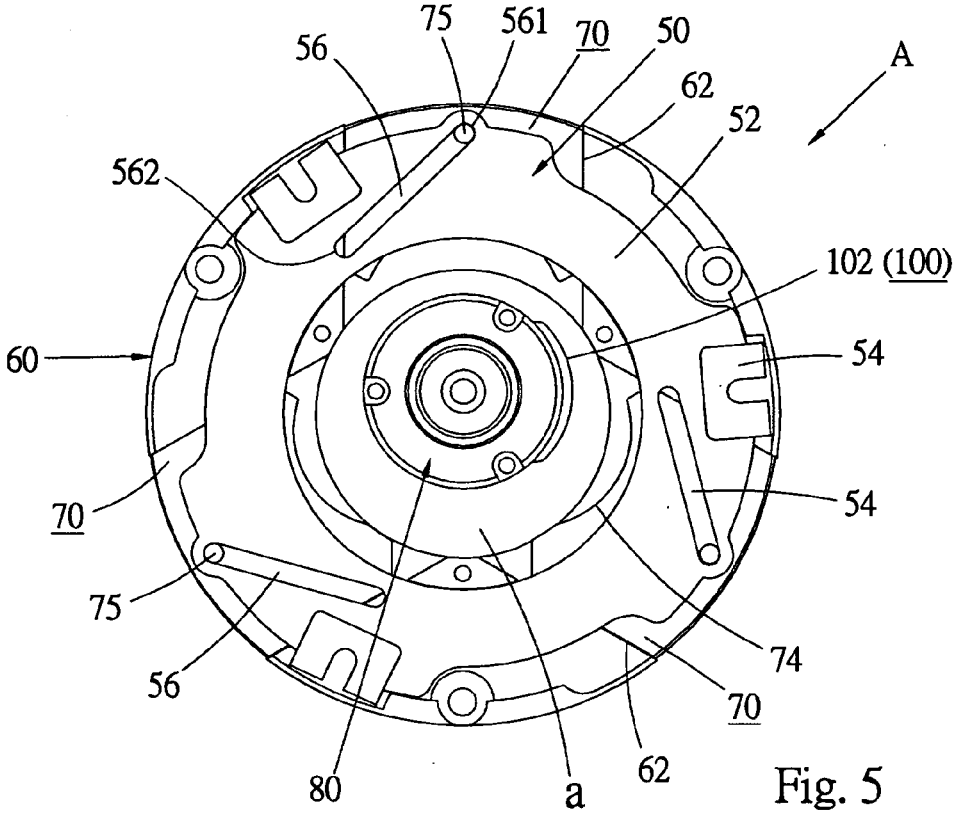
FIG. 5 is a top view of the linking device of the present invention, showing that the push plates are positioned in an expanded position.
Figure 6:
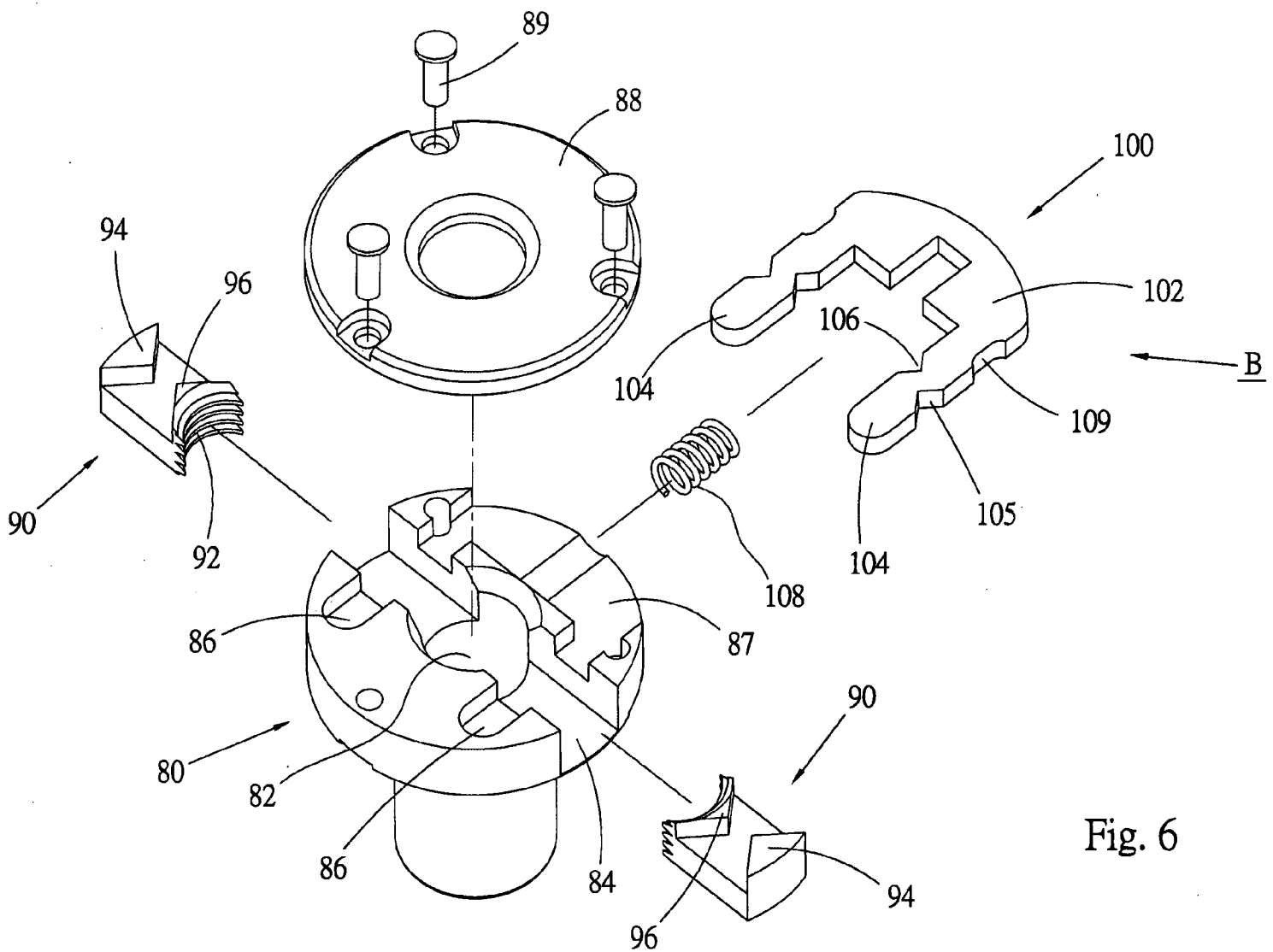
FIG. 6 is a bottom perspective view of the rotary shaft of the present invention.

After the three push plates 70 are mounted into the support tray 60, the support tray is fixedly connected with the annular body 30 as shown in FIG. 2, whereby the support tray is fixed under the bottom face of the annular body 30. The support tray and the push plates are attached to the bottom face of the body section 52 of the bracket 50. Referring to FIG. 6, the three guide posts 75 respectively extend into the guide slots 56. When rotating the bracket 50, via the guide slots 56, the guide posts 75 are guided to drive and displace the push plates 70. Referring to FIG. 5, the linking device A has an interior void section a, whereby the push plates 70 can be moved into or out of the void section a.

The present invention further includes a rotary shaft 80. Referring to FIG. 6, the center of bottom face of the rotary shaft 80 is formed with a shaft hole 82. A first slide way 84 is formed at the bottom end of the rotary shaft 80 along the radius thereof. The first slide way communicates with the shaft hole 82. Two second slide ways 86 are formed at the bottom end of the rotary shaft 80 and perpendicularly intersect the first slide way 84. The two second slide ways 86 are parallel to each other and respectively positioned on two sides of the shaft hole 82.

The present invention further includes a detent mechanism B having two detent members 90 and an operating member 100. The two detent members 90 are disposed in the first slide way 84 on two sides of the shaft hole 82. The detent members 90 are displaceable along the slide way 84. An inner end of each detent member 90 is formed with a threaded engaging section 92. In addition, the bottom face of the detent member 90 is formed with a wedge-shaped outer thrust section 94 and a wedge-shaped inner thrust section 96. The outer and inner thrust sections 94, 96 are respectively adjacent to the inner and outer ends of the detent member and spaced from each other by a certain distance.

Figure 7:
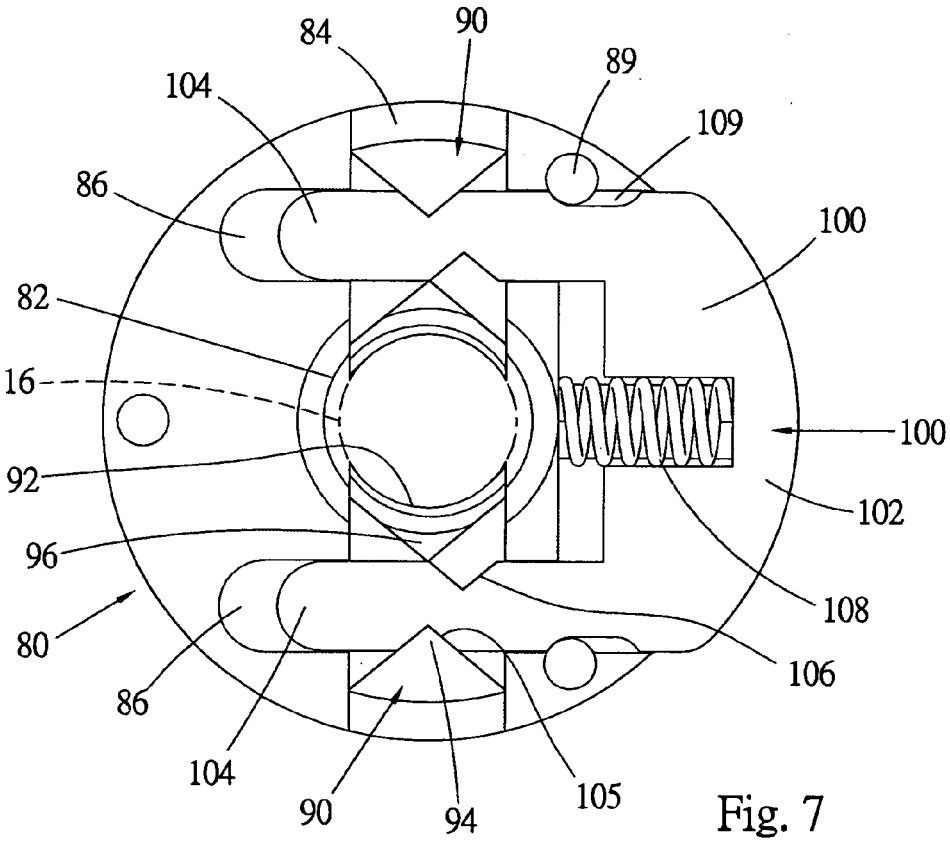
FIG. 7 is a bottom view showing that the detent members and operating member are mounted on the rotary shaft, in which the detent members are positioned in a closed position.

The operating member 100 has a body section 102 and two leg sections 104 outward extending from the body section. The inner and outer sides of each leg section 104 are respectively formed with two wedged-shaped push sections 105, 106. The operating member is mounted at the bottom end of the rotary shaft 80 with the two leg sections 104 respectively received in the two second slide ways 84 as shown in FIG. 7. The leg sections 104 are displaceable along the slide ways 84. Each leg section passes through the space between the inner and outer thrust sections 94, 96 of one of the detent members 90. The inner and outer push sections 105, 106 of the leg section 104 can operate the inner and outer thrust sections 94, 96 of the detent member. The body section 102 of the operating member is positioned in a recessed section 87 formed on the bottom end of the rotary shaft 80. One end of a spring 108 abuts against the body section 102, while the other end of the spring 108 abuts against the rotary shaft 80. The spring 108 serves to resiliently keep the operating member in an outer position. When the outer push section 105 is coupled with the outer thrust section 94, the operating member is positioned in an outer dead end of the travel. At this time, the body section 102 of the operating member protrudes from the rotary shaft 80. When the inner push section 106 is coupled with the inner thrust section 95, the operating member is positioned in an inner dead end of the travel.

The present invention further includes a bottom cover 88 which is locked at the bottom end of the rotary shaft 80 by three pins 89 to seal the bottom end. In this embodiment, two sides of the operating member 100 are respectively formed with two dents 109. Two pins 89 are respectively seated in the two dents 109. When the pin 89 abuts against two ends of the dent 109, the operating member also reaches the inner and outer dead ends of the travel.

The rotary shaft 80 is eccentrically pivotally connected with the bottom end of the driving shaft 26 of the driving device as shown in FIG. 3. The rotary shaft 80 is drivable by the driving shaft 26. The rotary shaft is eccentrically arranged for creating vibration effect when rotated. This pertains to prior art. The rotary shaft is positioned in the void section a of the linking device A. The operating member 100 is positioned at a height equal to the height of the push plates 70.

Figure 4:
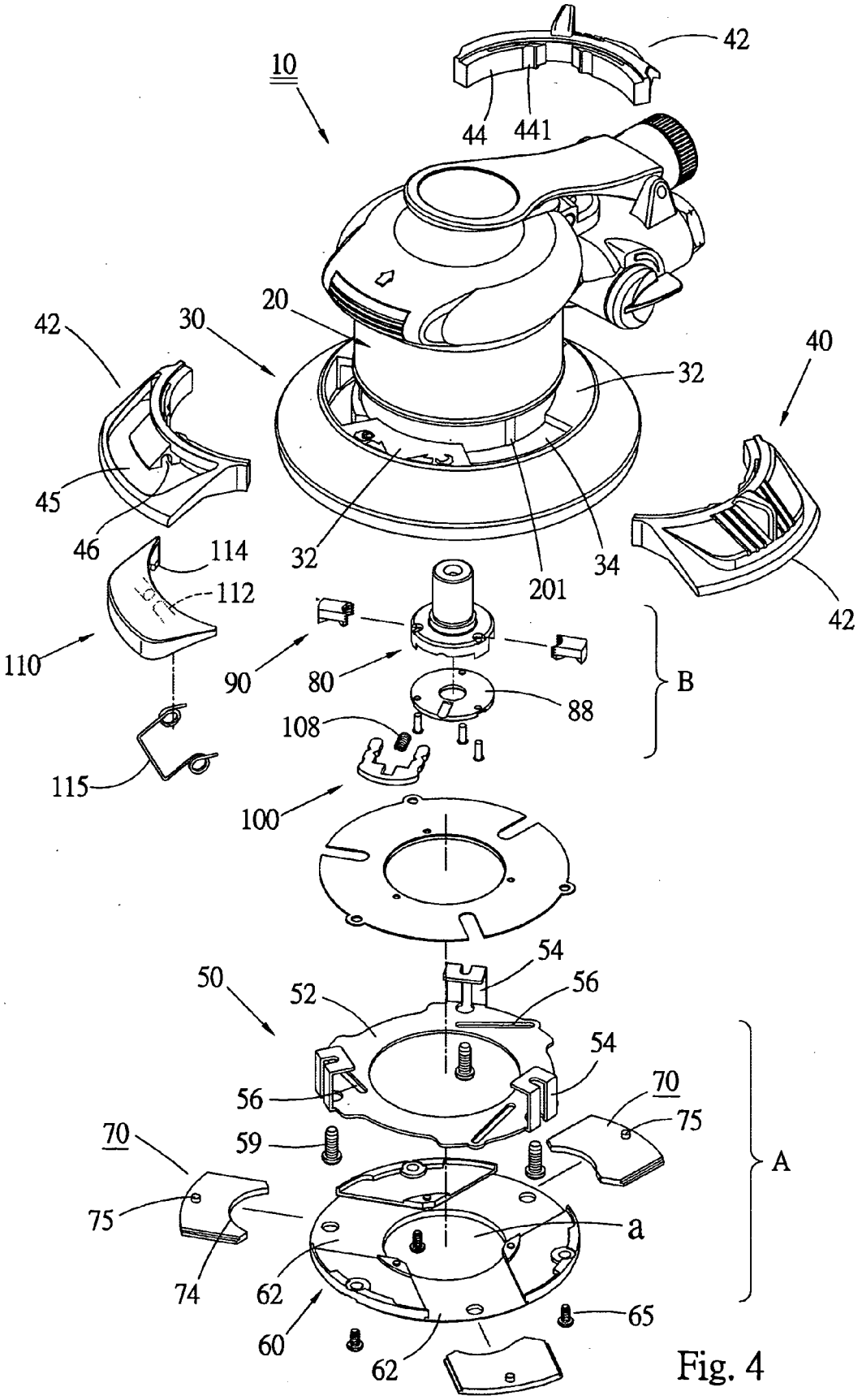
FIG. 4 is a perspective exploded view according to FIG. 1.
Figure 8:
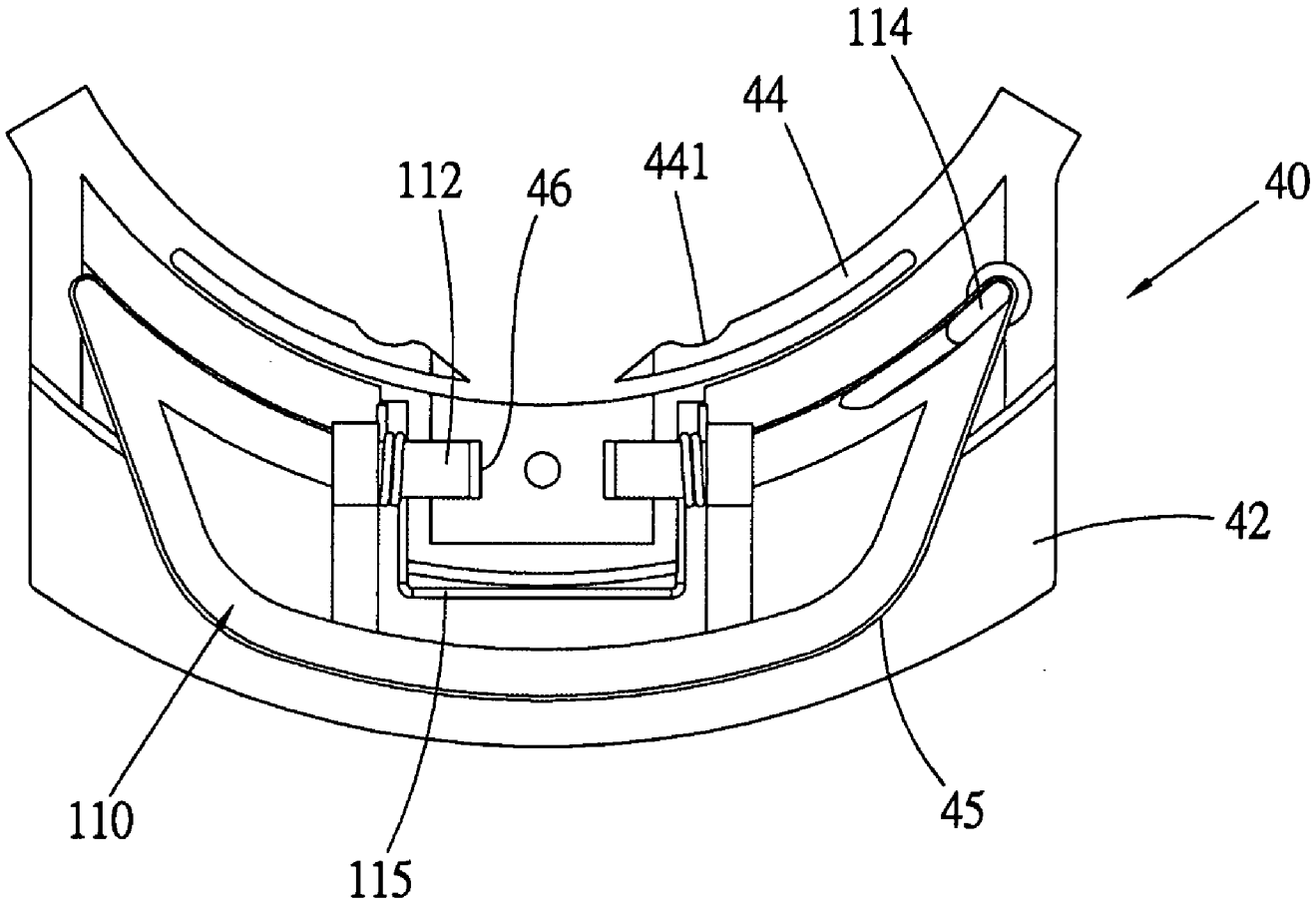
FIG. 8 is a bottom view showing that the insurance mechanism is mounted on the rotary switch.
Figure 9:
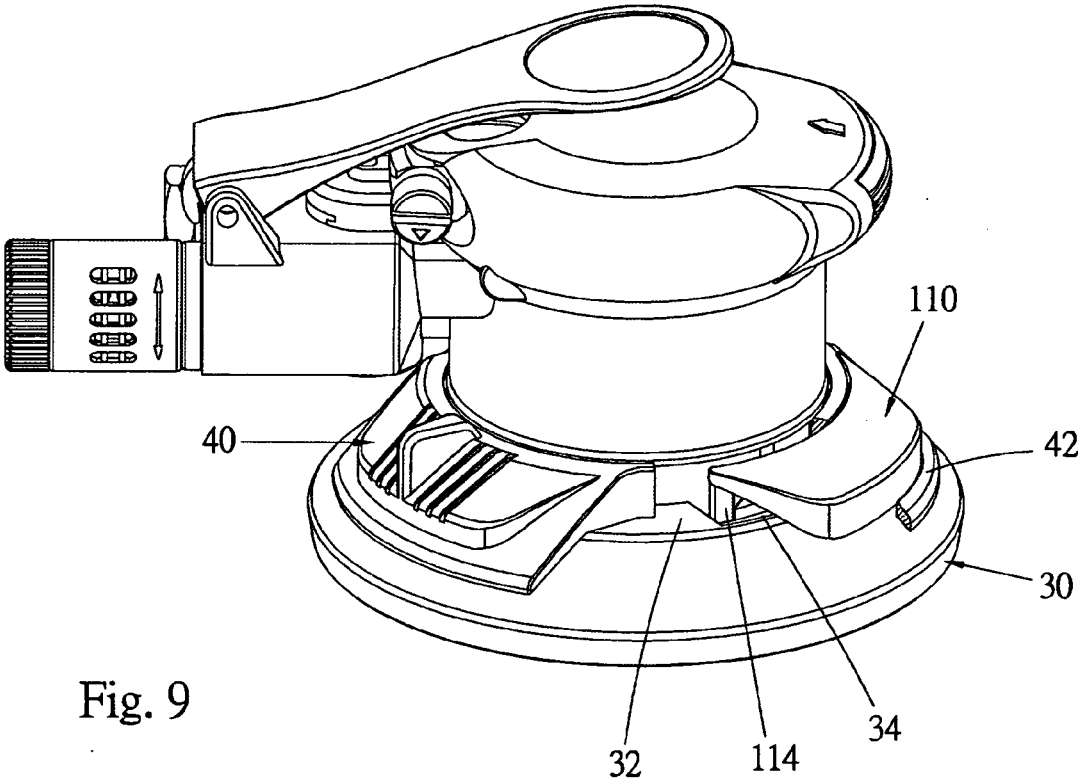
FIGS. 9 and 10 are partially sectional views according to FIG. 1, showing the structure and operation of the insurance mechanism.

Referring to FIGS. 4 and 8, the embodiment of the present invention further includes an insurance mechanism which is an insurance switch 110 mounted in a hollow section 45 of an arched body 42 of the rotary switch 40. Two shaft sections 112 are disposed on bottom face of the insurance switch 110. The shaft sections 112 are pivotally connected in two holes 46 of the arched body 42, whereby the insurance switch 110 can be rotated. A torque spring 115 is fitted on the shaft sections 112. One end of the torque spring 115 abuts against the insurance switch 110, while the other of the torque spring 115 abuts against the arched body. The torque spring 115 serves to resiliently keep an inner end of the insurance switch 110 in a lower latched position. In this state, a stopper section 114 disposed at one end of the insurance switch extends into a hollow section 34 of the annular body 30 to abut against one side of a connecting section 32 as shown in FIG. 9. Under such circumstance, the insurance switch is in a latched state to prevent the rotary switch 40 from being rotated.

In use of the present invention, the grinding disc 15 as shown in FIG. 1 is mounted on the grinder. A shaft rod 16 at the center of the top face of the grinding disc is fitted into the shaft hole 82 of the rotary shaft 80 as shown in FIG. 3. In common state, the two detent members 90 are positioned in a closed position as shown in FIG. 7. The engaging sections 92 of the detent members are screwed with the thread of the shaft rod 16. The linking device A is positioned in a state as shown in FIG. 5 and the three push plates 70 are positioned in an expanded position.

Figure 10:
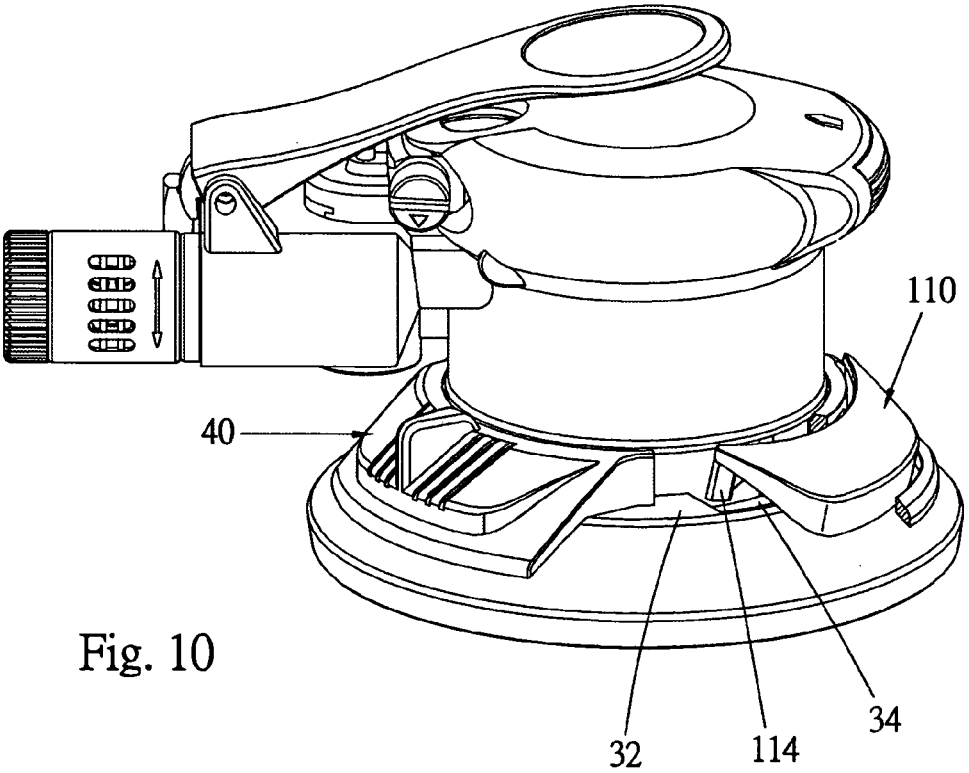

When replacing the grinding disc, first, as shown in FIG. 10, the outer end of the insurance switch 110 is pressed down to lift the stopper section 114 away from the hollow section 34. At this time, the insurance switch is positioned in a released position without abutting against the connecting section 32. Accordingly, the rotary switch 40 can be freely rotated. By means of clockwise rotating the rotary switch 40, the bracket 50 can be synchronously driven to angularly displace from a position as shown in FIG. 5 to a position as shown in FIG. 11. At this time, the guide posts 75 of the push plates 70 are moved from the outer ends 562 of the guide slots 56 to the inner ends 561 thereof. Accordingly, the push plates 70 are inward slid along the rail channels 62 of the support tray 60 to a closed position. At this time, the arched ends 74 of the push plates 70 are closed.

Figure 12:
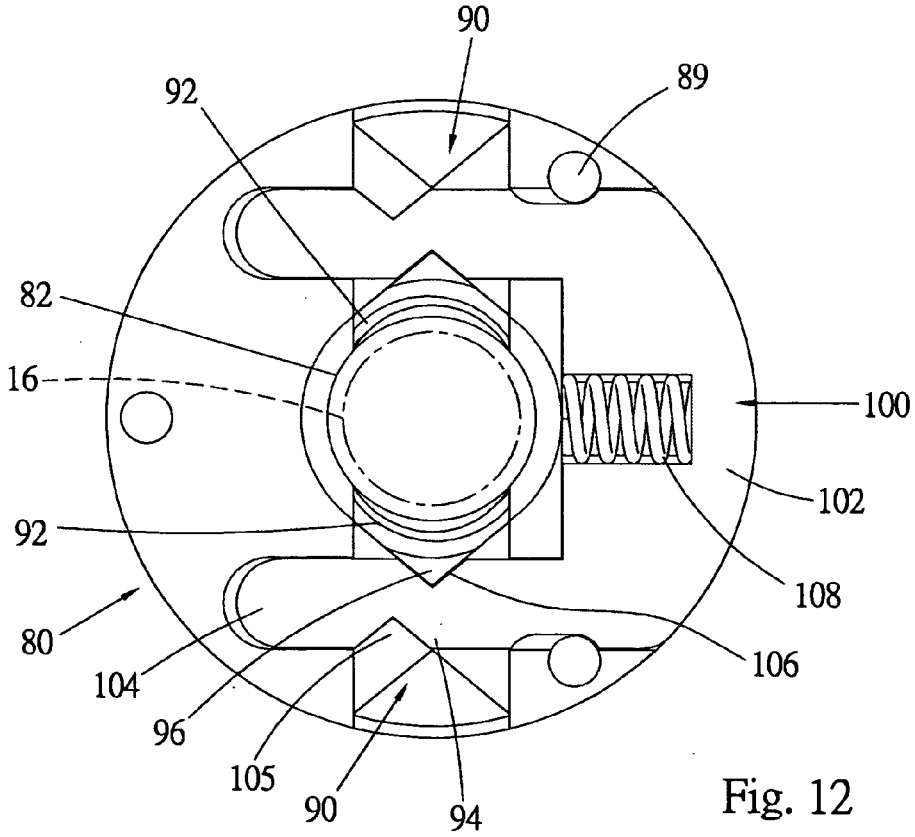
FIG. 12 is a view according to FIG. 7, showing that the push plates are positioned in the expanded position.

When the push plates 70 are closed, the push plates 70 are attached to the circumference of the rotary shaft 80 to push the body section 102 of the operating member 100. Accordingly, the operating member is moved into the rotary shaft in a state as shown in FIG. 12. At this time, the outer thrust sections 94 of the two detent members 90 leave the outer push sections 105 of the operating member and the inner thrust sections 96 of the detent members turn to couple with the inner push sections 106 of the operating member. By means of the above change of linking relationship, the detent members 90 outward slide along the first slide way 84 to increase the distance between the two engaging sections 92. At this time, the shaft rod 16 of the grinding disc is disengaged from the engaging sections 92 and released. Accordingly, the grinding disc can be quickly separated from the grinder.

When installing another grinding disc onto the grinder, in the state of FIG. 12, the shaft rod of the grinding disc is fitted into the shaft hole 82 of the rotary shaft 80. Then, the rotary switch 40 is counterclockwise rotated to drive the bracket 50 from the position of FIG. 11 back to the position of FIG. 5. At this time, the three push plates 70 are outward moved along the rail channels 62 and no more tightly attached to the rotary shaft. Accordingly, the operating member 100 is no more pressed by the push plates and is pushed by the spring 108 to move outward back to the state of FIG. 7. At this time, the inner thrust section 96 of the detent member 90 leaves the inner push section 106 of the operating member and the outer thrust section 94 turns to couple with the outer push section 105. Accordingly, the engaging sections 92 of the two detent members get close to each other again to engage with the shaft rod of the grinding disc. At this time, the installation of the grinding disc is completed.

When the rotary switch 40 is restored to the position of FIG. 9, the insurance switch 110 is pushed by the torque spring 115, whereby the stopper section 114 again extends into a hollow section 34 to abut against a connecting section 32 and provide an insurance effect.

According to the above installation measure of the present invention, the shaft rod 16 of the grinding disc is screwed in the thread hole formed by the two engaging sections 92. When the rotary shaft 80 is driven by the driving device 25 to rotate, the rotational direction of the rotary shaft 80 is reverse to the screwing direction of the shaft rod. Therefore, when the grinding disc is rotated, the shaft rod will more tightly engage with the engaging sections without detachment.

It should be noted that it is not inevitable to have two detent members in the present invention. Alternatively, one single detent member can also fix the shaft rod of the grinding disc in the shaft hole of the rotary shaft. Also, alternatively, the shaft rod of the grinding disc can be free from the thread. Instead, at least one notch is formed on the shaft rod and one or two detent members are engaged in the notch of the shaft rod to fix the shaft rod.

According to the above arrangement, the grinding disc can be fast installed/detached by means of simple operation without using any tool. The replacement of the grinding disc can be completed in several seconds. This is quite convenient.

The above embodiment is only used to illustrate the present invention, not intended to limit the scope thereof. Many modifications of the above embodiments can be made without departing from the spirit of the present invention.

What is claimed is:

1. A grinder with fast installable/detachable grinding disc, comprising:

a main body in which a driving device is installed;

a rotary switch mounted on the main body and manually operable to change position of the rotary switch;

a linking device mounted at bottom end of the main body and drivable by the rotary switch, whereby by means of operating the rotary switch, the linking device is driven to move between an expanded position and a closed position;

a rotary shaft, bottom end of the rotary shaft being recessed to form a shaft hole, the rotary shaft being disposed at bottom end of the driving device and drivable by the driving device to rotate; and a detent mechanism mounted in the rotary shaft, the detent mechanism having at least one detent member which is displaceable along the radius of the rotary shaft, an inner end of the detent member being formed with an engaging section, whereby when operating the rotary switch to drive and move the linking device between the expanded position and the closed position, the detent member is displaced to move the engaging section into or out of the shaft hole of the rotary shaft.

2. The grinder as claimed in claim 1, wherein the detent mechanism further includes at least one operating member disposed in the rotary shaft and displaceable along the radius of the rotary shaft, an inner end of the operating member serving to drive the detent member, whereby when the linking device is displaced between the expanded position and the closed position, the detent member is driven by the operating member to displace.

3. The grinder as claimed in claim 2, wherein the detent mechanism further includes a resilient member disposed between the operating member and the rotary shaft, the resilient member serving to resiliently keep the operating member in an outer dead end where an outer end of the operating member protrudes from the rotary shaft, when the linking device is positioned in the closed position, the linking device presses the outer end of the operating member to make the operating member move into the rotary shaft, whereby the detent member is driven by the operating member to move the engaging section out of the shaft hole, when the linking device is positioned in the expanded position, the operating member being not driven by the linking device and being positioned in the outer dead end, whereby the engaging section of the detent member is moved into the shaft hole.

4. The grinder as claimed in claim 3, wherein:

a first slide way is formed at the bottom end of the rotary shaft along the radius thereof, the first slide way communicating with the shaft hole, at least one second slide ways being formed at the bottom end of the rotary shaft, the second slide way intersecting the first slide way by a large angle;

the detent member is disposed in the first slide way and displaceable along the first slide way; and the operating member has a body section and at least one leg section outward extending from the body section, the leg section being disposed in the second slide way, whereby the operating member can be displaced along the second slide way, the leg section being drivingly connected with the detent member, whereby when the operating member is positioned in the outer dead end, the body section protrudes from the rotary shaft and when the operating member is displaced, the leg section drives the detent member to displace.

5. The grinder as claimed in claim 4, wherein an inner and an outer sides of the leg section of the operating member are respectively formed with an inner and an outer push sections, the inner and outer ends of the detent member being respectively formed with an inner and an outer thrust sections on one plane, the two thrust sections being spaced from each other by a certain distance, the leg section of the operating member passing through a space between the inner and outer thrust sections, whereby when the operating member is positioned in the outer dead end, the outer push section is coupled with the outer thrust section to move the engaging section of the detent member into the shaft hole, when the operating member is moved into the rotary shaft, the inner thrust section being coupled with the inner push section to move the engaging section of the detent member out of the shaft hole.

6. The grinder as claimed in claim 4, wherein two second slide ways are formed at the bottom end of the rotary shaft, the detent mechanism having two detent members and one operating member, the two detent members being disposed in the first slide way on two sides of the shaft hole, two leg sections outward extending from the same side of the body section of the operating member, the two leg sections being respectively disposed in the two second slide ways to engage with the two detent members.

7. The grinder as claimed in claim 4, wherein the bottom end of the rotary shaft is formed with a recessed section, the body section of the operating member being positioned in the recessed section.

8. The grinder as claimed in claim 1, wherein the linking device has an interior void section in which the rotary shaft is positioned.

9. The grinder as claimed in claim 8, wherein the linking device includes at least two push plates slidable along the radius of the rotary shaft, whereby when the linking device is positioned in the closed position, the push plates are inward displaced, while when the linking device is positioned in the expanded position, the push plates are outward displaced to move the inner ends of the push plates away from each other, whereby by means of the displacement of the push plates, the detent members of the detent mechanism are operated.

10. The grinder as claimed in claim 1, wherein the main body includes a hollow annular body, an inner circumference of the annular body having a predetermined number of connecting sections arranged at equal intervals for connecting with the bottom end of the main body, the connecting sections defining therebetween hollow sections the number of which is equal to the number of the connecting sections, the rotary switch being disposed around the annular body, the linking device being disposed in the annular body and connected with the rotary switch through the hollow sections, whereby the rotary switch can drive the linking device.

11. The grinder as claimed in claim 10, wherein the linking device includes:

a bracket having a hollow disc-shaped body section, a predetermined number of oblique guide slots being formed on the body section at certain intervals, the bracket being connected with the rotary switch through the hollow sections;

a support tray which is also a hollow tray body, rail channels being formed on top face of the support tray at equal intervals, the number of the rail channels being equal to the number of the guide slots, the longitudinal length of the rail channel being parallel to the radius of the support tray; and push plates the number of which is equal to the number of the rail channels, a guide post being disposed on each push plate, the push plates being respectively disposed in the rail channels and slidable along the rail channels, the support tray being fixedly connected with the bottom face of the annular body, the support tray and the push plates being attached to the bottom face of the body section of the bracket, the guide posts of the push plates respectively extending into the guide slots, the interiors of the support tray and the bracket serving as the void section, whereby when rotating the bracket, via the guide slots, the guide posts are guided to drive and displace the push plates.

12. The grinder as claimed in claim 11, wherein a predetermined number of leg supports are arranged on the body section of the bracket at certain intervals, the leg supports upward extending from the body section and respectively extending through the hollow sections to connect with the rotary switch.

13. The grinder as claimed in claim 10, wherein the rotary switch has an annular configuration and is fitted around the annular body.

14. The grinder as claimed in claim 13, wherein the rotary switch is composed of at least two arched bodies.

15. The grinder as claimed in claim 1, further comprising an insurance mechanism disposed between the rotary switch and the main body, the insurance mechanism being displaceable between a latched position and a released position, whereby when the insurance mechanism is positioned in the latched position, the rotary switch cannot be rotated, while when the insurance mechanism is positioned in the released position, the rotary switch can be rotated.

16. The grinder as claimed in claim 10, further comprising an insurance mechanism disposed between the rotary switch and the annular body, the insurance mechanism being displaceable between a latched position and a released position, whereby when the insurance mechanism is positioned in the latched position, the rotary switch is engaged with the annular body and cannot be rotated, while when the insurance mechanism is positioned in the released position, the rotary switch is disengaged from the annular body.

17. The grinder as claimed in claim 16, wherein the insurance mechanism is an insurance switch which is pivotally connected with the rotary switch and displaceable, one end of the insurance switch having a stopper section, whereby when the insurance switch is positioned in the latched position, the stopper section extends into a hollow section of the annular body to abut against a connecting section, while when the insurance switch is positioned in the released position, the stopper section is moved out of the hollow section.

18. The grinder as claimed in claim 17, further comprising a resilient member disposed between the insurance switch and the rotary switch, whereby in normal state, the resilient member serves to resiliently keep the stopper section of the insurance switch in a hollow section.

19. The grinder as claimed in claim 17, wherein the rotary switch is formed with a hollow section in which the insurance switch is pivotally disposed.

20. The grinder as claimed in claim 1, wherein a predetermined number of locating sections are disposed on the circumference of the main body and inner circumference of the rotary switch is formed with a predetermined number of engaging sections for engaging with the locating sections.

* * * * *